United States Patent [19]

Goettl

[11] 4,049,150

[45] Sept. 20, 1977

[54] PAN STRUCTURE

[76] Inventor: Adam D. Goettl, 4960 E. Palomino Road, Phoenix, Ariz. 85018

[21] Appl. No.: 545,428

[22] Filed: Jan. 30, 1975

[51] Int. Cl.[2] ..... B65D 7/42; B65D 5/24

[52] U.S. Cl. ..... 220/62; 220/83; 229/31 R

[58] Field of Search ..... 220/62, 73, 74, 83; 229/31 R, 31 FS

[56] References Cited

U.S. PATENT DOCUMENTS

| | | | |
|---|---|---|---|
| 927,537 | 7/1909 | Hothersall | 229/31 R |
| 1,446,394 | 2/1923 | Phillips | 220/73 X |
| 2,120,902 | 6/1938 | Moore | 229/31 R X |
| 2,377,989 | 6/1945 | Braun | 220/62 |
| 3,550,835 | 12/1970 | Persson | 229/31 R |

*Primary Examiner*—William Price
*Assistant Examiner*—Steven M. Pollard
*Attorney, Agent, or Firm*—Herbert E. Haynes, Jr.

[57] ABSTRACT

The top and sump pans of an evaporative cooler housing are formed of sheet metal and each have a planar surface with folded marginal flanges and are formed with diagonally folded corners that are structurally strong, leakproof and facilitate interconnection of the pans with corner posts or other suitable interconnecting structural members.

13 Claims, 26 Drawing Figures

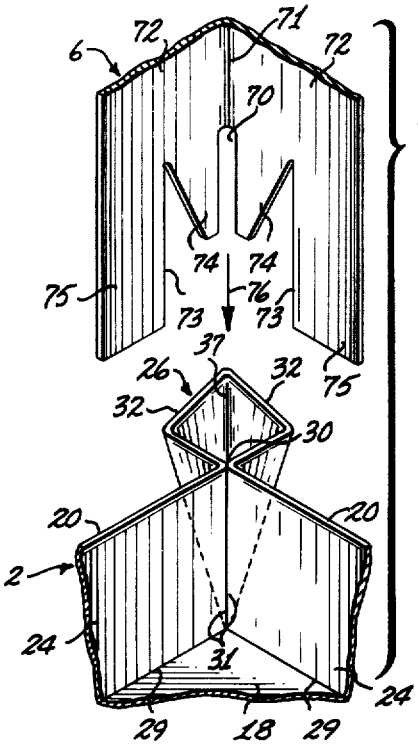
Fig. 12
Fig. 13
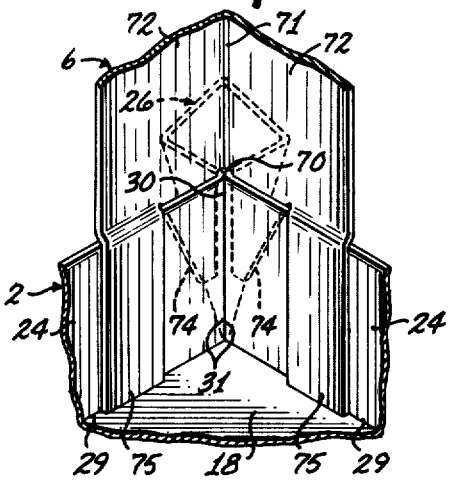
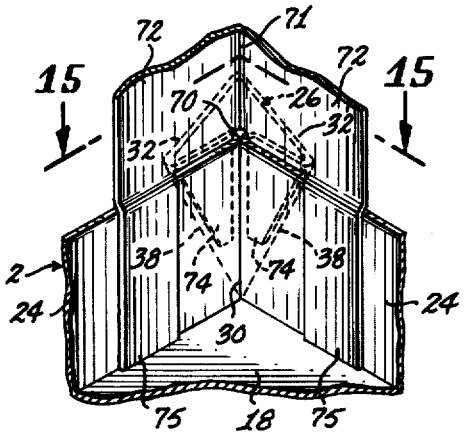
Fig. 14
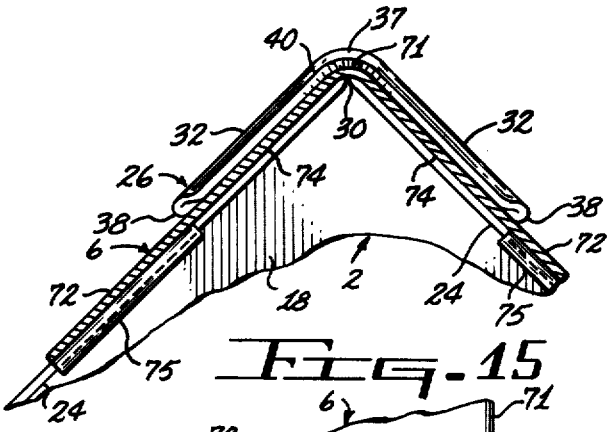
Fig. 15
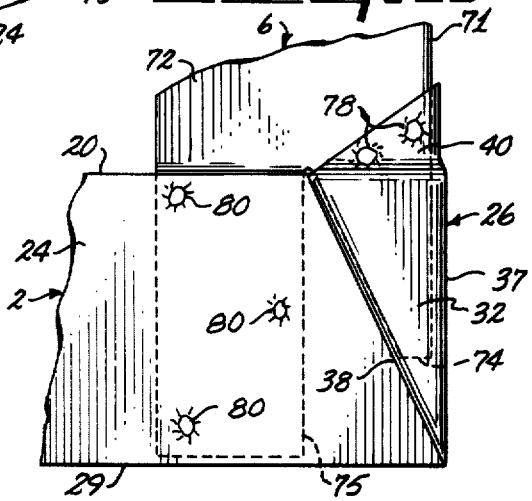
Fig. 16

PAN STRUCTURE

BACKGROUND OF THE INVENTION

1. Field of the Invention

This invention relates to evaporative coolers and more particularly to a pan shaped structure and method of making same in the construction of evaporative cooler housings.

2. Description of the Prior Art

In the construction of evaporative cooler housings it is a common practice to form two separate pan shaped structures one for the top and one for the sump or bottom. The top and sump pans are then interconnected with corner posts, and in some instances, two of the corner posts are replaced with a sheet metal panel structure which extends between the pans and forms one side wall of the finished cooler housing. In either event, the interconnecting structural members are attached such as with screws, welding and the like, to the top and sump pans, and in the case of the corner post type of interconnecting structure, this attachment is limited to the corners of the top and sump pans.

Therefore, the manner in which the corners of the pans are formed is particularly important in that those corners must be structurally strong, should be easy to assemble into a finished evaporative cooler housing and must be leakproof. Furthermore, the corners of such pans should ideally not require any notching, punching, trimming or other special operations either during or after fabrication and such corners should be aesthetically appealing.

One particular prior art pan structure employed a drawn rounded corner configuration which of course, was inherently leakproof but required a considerable amount of trimming after completion of the drawing operation. The equipment needed to fabricate such a rounded corner is very large and expensive and such a corner makes assembly of the housing difficult due to the problem of precisely locating and attaching a corner post or other pan interconnecting structure thereto.

Due to the difficulties associated with the above described rounded corner configuration, the most commonly employed corner structure is of square configuration.

In general, the prior art square corner configurations of the top and sump pans of evaporative cooler housings, and the techniques employed in fabricating such corners, have not satisfied the above described necessary and ideal characteristics due to a variety of factors. For example, some of the prior art square corner fabricating techniques require time consuming and costly special operations both during and after fabrication and result in corner configurations which are oftentimes unsightly, structurally weak, and must be rendered leakproof by the application of tar or other leakproofing substance. Further, some of these prior art square corner configurations are similar to the above described rounded corner in that special complex fixtures and excessive time is required to assemble the pan structures into a finished cooler housing.

Therefore, a need exists for a pan shaped structure having new and improved corner configurations and method of making same for use in the construction of evaporative cooler housings and which solves some of the problems of the prior art.

SUMMARY OF THE INVENTION

In accordance with the present invention, new and improved square corner configurations and method of making same is disclosed as being particularly suited for use in fabricating top and sump pans for evaporative cooler housings.

The pans are each fabricated from a single sheet of metal which is folded to provide a planar surface having marginal flanges which are normal to the planar surface, and having a partically folded corner tab at each corner. The ends of adjacent ones of the marginal flanges form a corner junction which is normal to the planar surface and the partially folded corner tab is an extension of the adjacent marginal flanges and is common to both of those marginal flanges.

If a simple unconnected pan structure is being formed, each of the partially folded corner tabs are collapsed diagonally toward the corner junction of their adjacent marginal flanges so that the plications of the fully collapsed corner tab will wrap around the corner and be in engagement with the end portions of both of the adjacent marginal flanges. Such collapsing of the corner tab will cause a flap portion thereof to extend beyond the limit of the adjacent marginal flanges, and that extending flap portion is bent over the edges of the adjacent flanges. A corner fabricated in this manner will have exceptional structural strength, will be interlocked and leakproof.

When a pan structure is being formed for interconnection to a similar pan structure as would be the case in fabrication of one type of evaporative cooler housing, especially slotted corner posts or other interconnecting structural members are interposed between the adjacent marginal flanges and the partially folded corner tabs.

The corner tabs are then collapsed diagonally toward the corner junction of their adjacent ones of the marginal flanges so that the plications, or folds, will wrap around the corner. In this manner, the slotted interposed interconnecting structural member will be interlockingly positioned between the adjacent marginal flanges and the plications of the completely folded corner tabs and interconnection of the pans is accomplished with an inherently strong corner structure that is leakproof.

A single sheet of metal may be formed in accordance with the techniques of the present invention to fabricate an evaporative cooler housing in which the sump pan, top pan and one side closing panel thereof are unitary. Such one piece fabrication results in the production of evaporative cooler housings of exceptional strength with minimal fabrication operations and cost.

Accordingly, it is an object of the present invention to provide a new and useful corner structure and method of making same.

Another object of the present invention is to provide a new and useful corner structure and method of making same which is particularly suited for use in fabrication of a pan shaped structure.

Another object of the present invention is to provide a new and useful corner structure and method of making same which is particularly suited for use in fabricating the top and sump pans of an evaporative cooler housing.

Still another object of the present invention is to provide a new and useful corner structure and method of making same which is particularly suited for fabrication of the top and sump pans of an evaporative cooler housing with those corner structures facilitating interconnection of the pans and providing corners which are structurally strong, fully interconnected with the pans themselves as well as the interconnecting structures and are leakproof.

Yet another object of the present invention is to provide a new and useful corner in a pan shaped structure and method of making same of the above described character which is particularly adapted for use in fabricating unitary evaporative cooler housings.

The foregoing and other objects of the present invention, as well as the invention itself, may be more fully understood from the following description when read in conjunction with the accompanying drawings.

BRIEF DESCRIPTION OF THE DRAWINGS

FIG. 12 is a fragmentary isometric exploded view of a pan shaped structure and a pan interconnecting structure, with the pan having the first embodiment of the corner structure of the present invention shown thereon in a partially folded position ready to receive the pan interconnecting structure.

FIG. 13 is a fragmentary isometric view similar to FIG. 12 and illustrating the pan interconnecting structure assembled to the pan.

FIG. 14 is a fragmentary isometric view similar to FIG. 13 showing the first embodiment of the corner structure of the present invention in the fully folded position.

FIG. 15 is an enlarged sectional view taken on the line 15—15 of FIG. 14.

FIG. 16 is a fragmentary side elevational view of the structure of FIGS. 14 and 15 and illustrating the ideal locations for spot welding of the structure.

DESCRIPTION OF THE PREFERRED EMBODIMENTS

Figure 1:
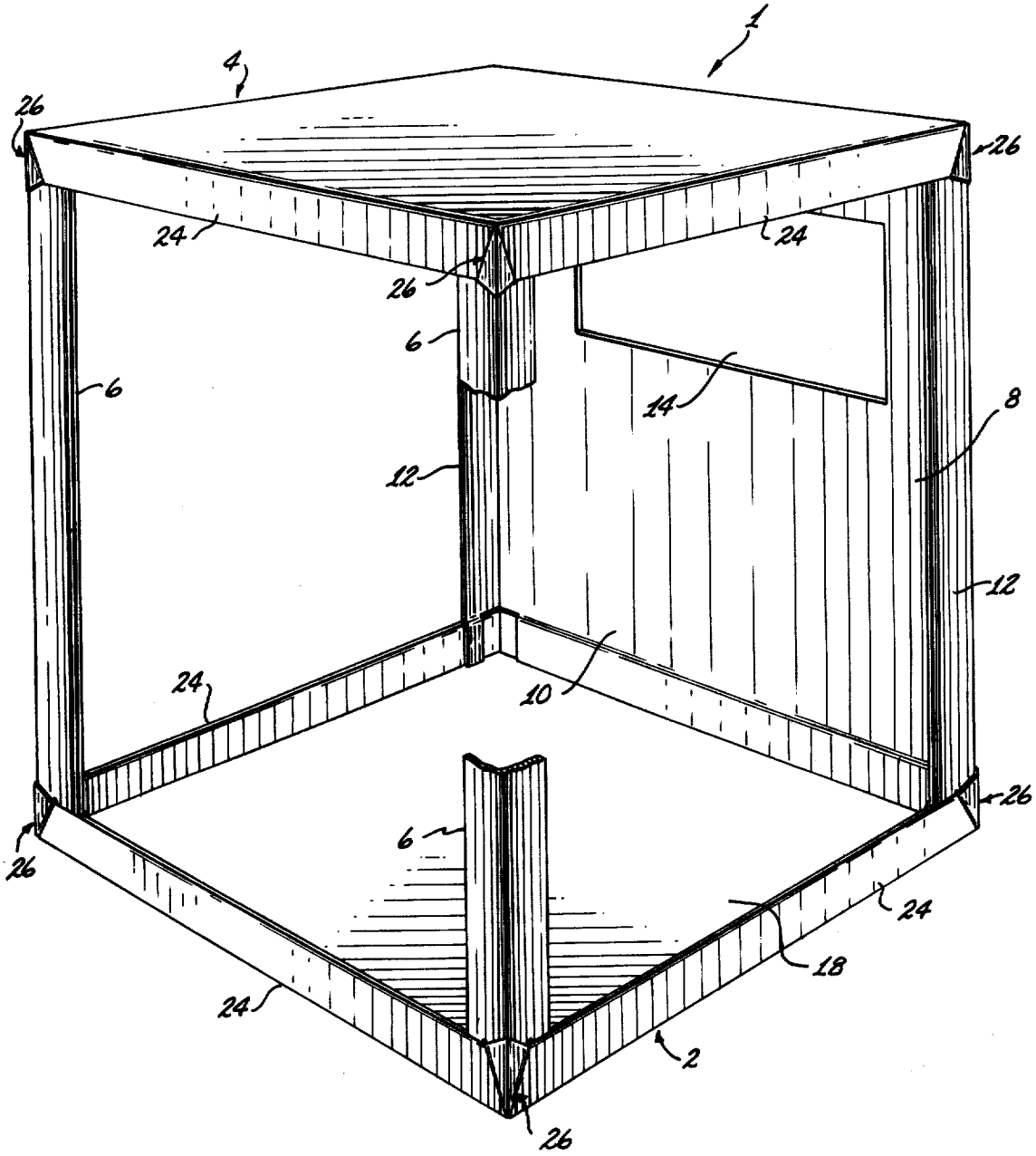
FIG. 1 is a perspective view of one type of evaporative cooler housing which is fabricated with the corner structures of the present invention.

Referring more particularly to the drawings, FIG. 1 illustrates an evaporative cooler housing which is indicated generally by the reference numeral 1. The cooler housing 1 is of the type employed in the fabrication of an evaporative cooler assembly known in the industry as a "side draft" cooler as will hereinafter be described in detail.

The housing 1 is fabricated with an upwardly opening sump pan 2 and an identical inverted top pan 4 which are spaced apart and interconnected with pan interconnecting elements or structures which in this particular type of housing 1 includes a pair of corner posts 6 and a side closing panel 8.

Each of the corner posts 6 is an elongated element which is angular in cross-section and is especially slotted at each of its opposite ends for interlocking assembly between aligned corners of the sump pan 2 and the top pan 4 of the housing 1 as hereinafter will be described in detail.

The side closing panel 8 is fabricated of sheet metal and is formed to have a planar surface 10 with a side flange 12 formed on each of the opposite vertical sides of the planar surface 10. The flanges 12 are each normal to the planar surface 10 so as to provide an angular in cross-sectional relationship at each of the opposite vertical sides of the panel, with that relationship being the same as the angular configuration of the corner posts 6. The panel 8 is especially slotted at each of its corners for interlocked assembly between aligned pairs of the corners of the sump pan 2 and top pan 4 as will hereinafter be described in detail.

The housing fabricated as described above includes an interior area which is employed, as is customary, to house the conventional elements of an evaporative cooler such as a centrifugal blower (not shown), drive mechanism (not shown) and a water distribution system (not shown). The particular housing 1 is configured to have one closed and three open sides, with the open sides being employed for demountably retaining the usual evaporative cooler pads (not shown). The panel 8 which closes the remaining side of the housing 1 is formed with an opening 14 therethrough which serves as the outlet from the centrifugal blower (not shown). The physical location of the outlet opening 14 in the side of the housing 1 is what determines that the housing is of the side draft type.

Another type of cooler housing (not shown) is known in the industry as a "down draft" cooler in that its centrifugal outlet is provided through the sump pan. In that particular type of evaporative cooler, the pan interconnecting elements would be in the shape of the previously described corner posts 6 with an additional pair of such posts replacing the side closing panel 8. Thus, it may now be seen that various combinations of pan interconnecting structures may be employed in the fabrication of evaporative cooler housings.

As hereinbefore mentioned, the opposite ends of the corner posts 6 and each of the corners of the closing panel 8 are especially slotted. This special slotting, which will be hereinafter described in detail, is accomplished so that these pan interconnecting elements will be interlockingly engagable with special corner structures of the sump pan 2 and top pan 4.

Since the sump pan 2 and the top pan 4 are identical, it should be understood that the following description of the sump pan 2 also applies to the top pan 4.

Figure 2:
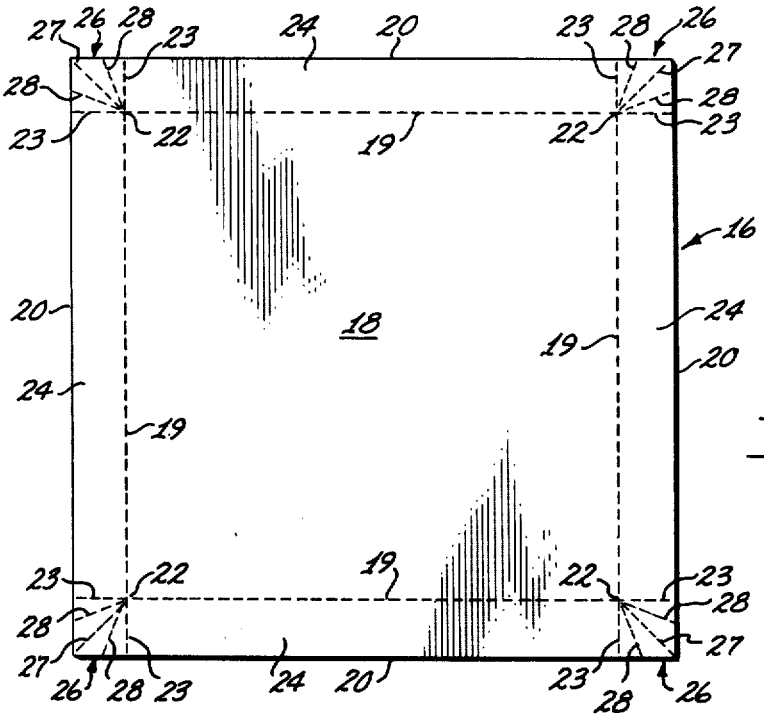
FIG. 2 is a plan view of a flat blank of sheet metal illustrating, by broken lines, the bending and folding locations utilized in forming that flat blank of sheet metal into a pan shaped structure.

As seen in FIG. 2 and as now will be described, a flat blank 16 of sheet metal is employed in the formation of the sump pan 2. The flat blank 16 has a planar surface 18 which is outlined by broken lines 19. The planar surface may be either square or rectangular and will serve as the bottom surface of the sump pan 2.

Each of the broken lines 19 is parallel and spaced inwardly from a different one of the side edges 20 of the flat blank 16, and the broken lines 19 intersect at points 22 adjacent to each of the corners of the blank 16. Thus, each of the broken lines 19 extend between a pair of the intersecting points 22 and continue beyond those points to provide extended broken lines 23. The areas 24 of the flat blank 16 outlined by one broken line 19, one side edge 20, and an opposed pair of the extended broken lines 23 will serve as marginal flanges when formation of the sump pan 2 is completed as hereinafter will be described in detail.

The four remaining areas 26 of the flat blank 16 are corner tabs each of which may be defined as an area included between an adjacent pair of the extended broken lines 23 and an adjacent pair of the side edges 20 of the flat blank 16.

Each of the corner tabs 26 also have a diagonal broken line 27 extending from the intersecting point 22 to the corner of the flat blank 16, and a pair of bisecting broken lines 28 extending outwardly from the intersecting point 22 on opposite sides of the diagonal broken line 27. The purpose for the diagonal and bisecting broken lines 27 and 28, respectively, will become apparent as the description progresses.

It will be understood that the broken lines 19, 23, 27, and 28 represent break lines on which the sheet metal flat blank 16 is bent and folded to produce the sump pan 2 having the corner structures of the present invention.

Figure 3:
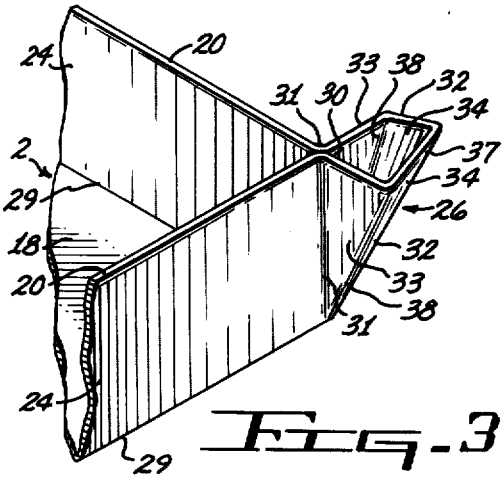
FIG. 3 is an enlarged fragmentary isometric view of a pan shaped structure formed from the flat blank of a sheet metal shown in FIG. 2, and illustrating the first step accomplished in forming the first embodiment of the corner structure of the present invention.
Figure 4:
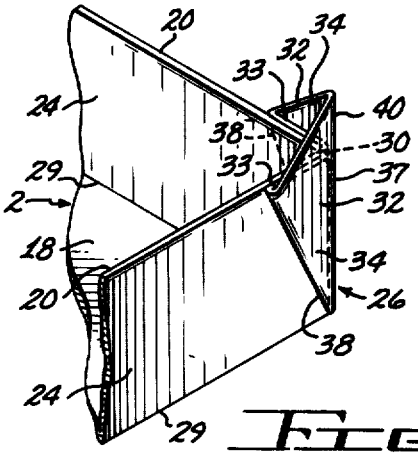
FIG. 4 is a view similar to FIG. 3 and illustrating the second step accomplished in forming the first embodiment of the corner structure of the present invention.
Figure 5:
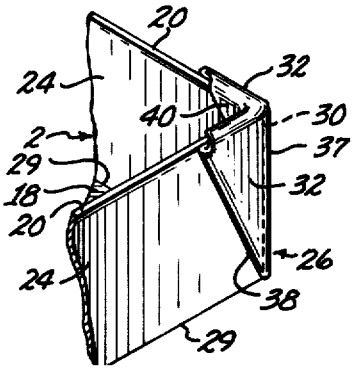
FIG. 5 is another view similar to FIG. 3 which illustrates the final step in forming the first embodiment of the corner structure of the present invention when that corner structure is employed in forming a simple unconnected pan shaped structure.

Reference is now made to FIGS. 3, 4, and 5 which illustrate the steps of forming a first embodiment of the corner structure of the present invention.

FIG. 3 shows a fragmentary portion of the sump pan 2 as having had the marginal flanges 24 folded along the broken lines 19 (FIG. 2) until those flanges 24 are positioned normal to the planar surface 18, which changes these broken lines 19 (FIG. 2) into fold lines 29. When this step of folding the marginal flanges 24 is accomplished, the extending broken lines 23 (FIG. 2) which define the ends of adjacent ones of the flanges 24 become fold lines 31 and will move into contiguous engagement with each other to form a corner junction 30 which is also normal to the planar surface 18.

At this stage of the formation of the sump pan 2, the corner tab 26 will have been partially folded into an outward extending substantially funnel shaped configuration. It should be understood that the angular four sided configuration of the partially folded corner tab 26 will occur as shown only if the tab 26 is intentionally folded along the diagonal and bisecting broken lines 27 and 28 (FIG. 2). Otherwise, the partially folded tab 26 will assume a smoother somewhat circular configuration which may be defined as an inverted oblique circular cone.

FIG. 4 illustrates the next steps of folding the partially folded corner tab 26 diagonally toward the corner junction 30 to bring the diagonal broken line 27 (FIG. 2) into contiguous engagement with the corner junction 30. The laterally disposed portions 32 of the corner tab 26 which are on opposite sides of the diagonal broken line 27 (FIG. 2) are then folded about the diagonal broken line 27 (FIG. 2) until these lateral portions 32 are folded along the bisecting broken lines 28 (FIG.2) to provide an inner segment 33 and an outer segment 34. The inner segment 33 and the outer segment 34 are folded back on each other so as to be wrapped around the corner junction 30 and are thus moved into engagement with portions of the adjacent marginal flanges 24. It may now be seen that as a result of previously described steps of folding the partially folded corner tab 26 and wrapping of the laterally disposed portions 32 around the corner junction 30, the diagonal broken line 27 (FIG. 2) has become a fold line 37 and the bisecting broken lines 28 (FIG. 2) have become fold lines 38.

It should be understood that the previously described steps of folding and wrapping of the partially folded corner tab 26 will ideally be accomplished in a single step which may be defined as collapsing the corner tab diagonally into engagement with the corner junction and angularly into engagement with the marginal flanges that form that corner junction.

These previously described steps or step result in an upwardly extending flap portion 40 which as shown in FIG. 5 may be folded inwardly and downwardly so as to interlock the folded corner.

Figure 6:
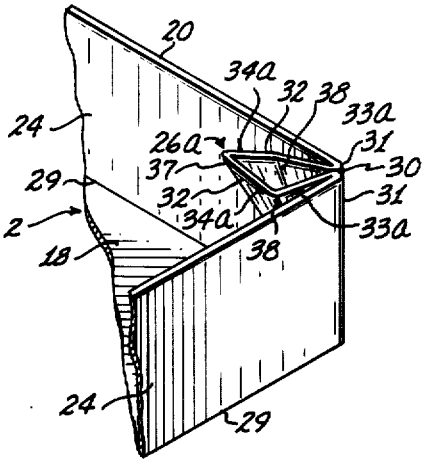
FIG. 6 is a fragmentary isometric view of a pan shaped structure formed from the flat blank of sheet metal shown in FIG. 2 and illustrating the first step accomplished in forming a second embodiment of the corner structure of the present invention.
Figure 7:
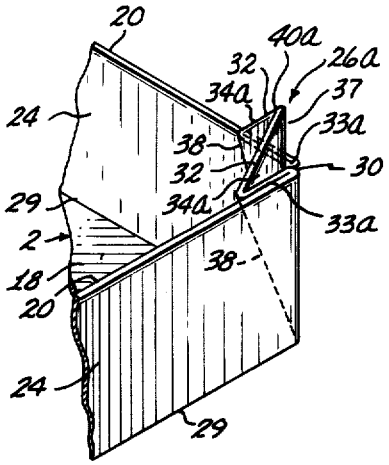
FIG. 7 is a view similar to FIG. 6 and illustrating the second step accomplished in formation of the second embodiment of the corner structure of the present invention.
Figure 8:
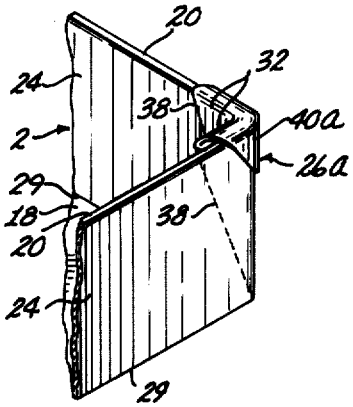
FIG. 8 is another view similar to FIG. 6 which illustrates the final step in formation of the second embodiment of the corner structure of the present invention when that corner structure is employed in fabrication of a simple unconnected pan shaped structure.

Reference is now made to FIGS. 6, 7, and 8 which illustrate the steps of forming a second embodiment of the corner structure of the present invention.

FIG. 6 shows the sump pan 2 as having had the marginal flanges 24 folded along the broken lines 19 (FIG. 2) which changes those broken lines into fold lines 29 and to position those flanges 24 normal to the planar surface 18, which, as previously described in relation to the first embodiment, will also position the extending broken lines 23 (FIG.2) which become fold lines 31 in contiguous engagement with each other at the corner junction 30. As before, the corner junction 30 is normal to the planar surface 18.

The partially folded corner tab 26*a* which exists at this stage of the forming of the sump pan 2, extends inwardly as opposed to the outwardly extending partially foled tab 26 of the previously described first embodiment.

FIG. 7 illustrates the next step of folding the inwardly extending partially folded corner tab 26*a* diagonally toward the corner junction 30 to bring the diagonal broken line 27 (FIG. 2) into contiguous engagement with the corner junction 30. The laterally extending portion 32 of the collapsed inwardly extending corner tab 26*a* are angularly folded about the broken line 27 (FIG. 2) during the diagonally folding step so that the laterally extending portions 32 will be folded along the bisecting broken lines 28 (FIG. 2) to form an inner segment 33*a* and an outer segment 34*a*. The inner and outer segment 33*a* and 34*a* will be folded back on each other and thus will be wrapped about the corner junction 30 and brought into engagement with end portions of the adjacent marginal flanges 24. When the steps of folding and warappng, i.e., the collapsing step, is completed, the broken line 27 (FIG. 2) becomes the fold line 37 and the bisecting broken lines 28 (FIG. 2 ) become fold lines 38 as previously described.

The upwardly extending flap 40*a* which results from the step of collapsing the inwardly extending partially folded corner tab 26*a* may be folded outwardly and downwardly as shown in FIG. 8 to firmly interlock this second embodiment of the folded corner.

Figure 9:
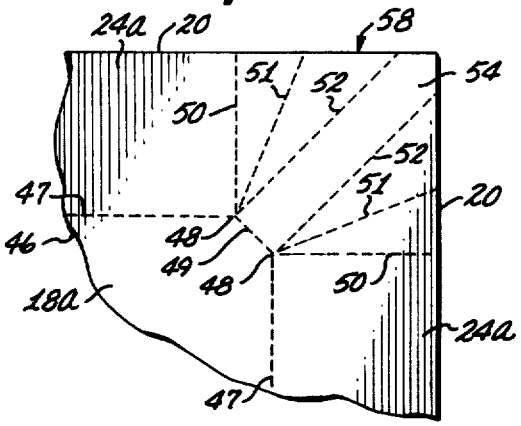
FIG. 9 is a fragmentary plan view of the flat blank of sheet metal which illustrates in broken lines, the bending and folding lines utilized in formation of a third embodiment of the corner structure of the present invention.
Figure 10:
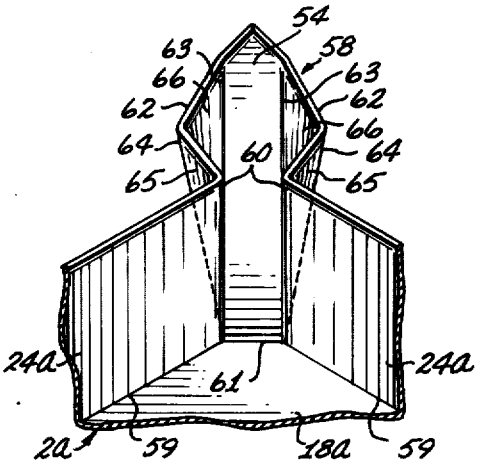
FIG. 10 is a fragmentary isometric view of a pan shaped structure formed from the sheet metal blank shown in FIG. 9 and illustrating the first step accomplished in forming the third embodiment of the corner structure of the present invention.
Figure 11:
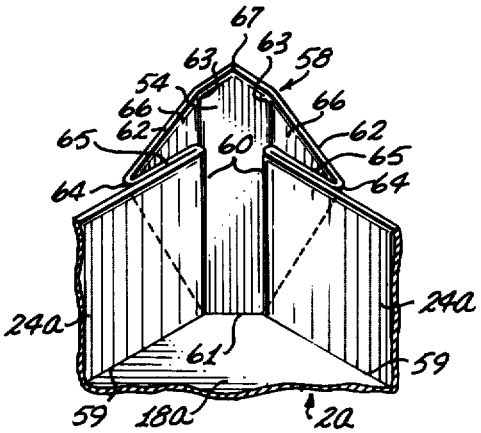
FIG. 11 is a view similar to FIG. 10 which shows the second step employed in formation of the third embodiment of the corner structure of the present invention.

Reference is now made to FIGS. 9, 10, and 11 which illustrate a fragmentary portion of a modified form of flat blank 46 and the steps involved in forming a third embodiment of the folded corner of the present invention.

In this embodiment the planar surface 18*a* of the flat blank 46 is outlined by broken lines 47 (two shown in FIG. 9) which terminate at points 48 just short of intersecting with each other so that each corner (one shown) has two spaced apart terminal points 48. The two terminal points 48 are connected by a bevelled broken line 49. An extending broken line 50, a bisecting broken line 51, and a diagonal broken line 52 extend outwardly from each of the terminal points 48. It may now be seen that the several broken lines of the flat blank 46 differ from the broken lines of the previously described flat blank 16 in that the blank 46 has two spaced apart parallel diagonal broken lines 52 and the bevel line 49 which outline a bevel surface 54 as hereinafter will be described in detail.

In this embodiment, the marginal flanges 24*a* of the flat blank 46 are each outlined by one of the broken lines 47, one of the side edges 20 of the blank 46 and an opposed pair of extending broken lines 50 (one shown). The corner tabs 58 (one shown) of this embodiment are outlined by adjacent ones of the extending broken lines 50, the bevelled broken line 49 and an adjacent pair of the sides 20 of the flat blank 46.

FIG. 10 shows a fragmentary portion of the sump pan 2*a* as having the marginal flanges 24*a* folded along the broken lines 47 (FIG. 9) which changes those broken lines into fold lines 59 and positions those flanges 24*a* normal to the planar surface 18*a*. When this step of folding the marginal flanges 24*a* is accomplished, the extending broken lines 50 (FIG. 9) which define the ends of adjacent ones of the flanges 24*a* will move into positions which are normal to the planar surface 18*a*, and those lines 50 (FIG. 9) will be spaced and parallel to each other. This relationship may be seen best in FIG. 10 wherein the extending broken lines 50 (FIG. 9) have become fold lines 60 as a result of the above described step of folding the marginal flanges 24*a*, and those spaced fold lines 60 define the corner junction in this embodiment of the present invention.

Also as seen in FIG. 10, the step of folding the marginal flanges 24*a* as described above, will cause the corner tab 58 to move into a partially folded outwardly extending position.

FIG. 11 illustrates the next step of folding the partially folded corner tab 58 diagonally toward the corner junction which is defined by the spaced apart fold lines 60 to bring the diagonal broken lines 52 (FIG. 9) into contiguous engagement with their respectively aligned ones of the fold lines 60. This same step of diagonally folding the partially folded coner tab 58 will cause the bevel surface 54 thereof to move about the bevelled broken line 49 (FIG. 9) so that the bevelled broken line becomes the bevelled fold line 61, and the bevelled surface 54 is positioned normal to the planarsurface 18*a* so as to extend between the spaced apart parallel fold lines 60. The laterally disposed portions 62 of the diagonally folded corner tab 58, which are on opposite sides of the bevelled surface 54, are then angularly folded about their respective ones of the diagonal broken lines 52 (FIG. 9) so as to wrap the corner tab 58 about the corner junction which causes those diagonal broken lines 52 (FIG. 9) to become fold lines 63. This same step of wrapping the laterally disposed portions 62 about the the corner junction will also cause those portions to become folded about their respective bisecting broken lines 51, (FIG. 9) which results in those broken lines 51 (FIG. 9) becoming fold lines 64, and also results in the formation of an inner segment 65 and an outer segment 66 in each of the folded laterally disposed portions. The resulting position of the inner and outer segments 65 and 66 is that they are folded back on each other and in engagement with end portions of the adjacent marginal flanges 24*a*.

As hereinbefore described, the previously described steps of folding the corner tab diagonally and wrapping the laterally disposed portions thereof about the corner junction may be accomplished in a single collapsing operation or step.

Although not illustrated, the upwardly extending flap portion 67 which is shown in FIG. 11 may be folded inwardly and downwardly in a manner previously described with reference to the flap 40 so that a completely fast interlocked corner results.

It will be noted that the previously described formation of the three embodiments of the corner structure of the present invention resulted in interlocked folded corner structures which are structurally strong and leakproof. The pan shaped structures formed with any one of those previously described corner configurations are not particularly well suited for attachment of pan interconnecting structural members such as the previously discussed corner posts 6 and panel 8. However, those same corner configurations lead themselves very well for attachment of pan interconnecting structural members thereto if an additional step or steps are included in the formation thereof as will now be described in detail.

Referring now to FIGS. 12 through 16 wherein a pan interconnecting structural element, shown as a corner post 6, is being installed and affixed to first embodiment of the corner structure of the present invention.

FIG. 12 shows a fragmentary portion of the sump pan 2 as having had the marginal flanges 24 folded about the fold lines 29 to position those flanges normal to the planar surface 18. As previously described, folding of the marginal flanges 24 will move the fold lines 31 into contiguous engagement with each other to provide the normal corner junction 30, and will cause formation of the outwardly extending partially folded corner tab 26. When the formation of the sump pan 2 has reached this stage, assembly of the pan interconnecting structures 6 thereto is accomplished.

As hereinbefore described, the pan interconnecting structural member in the form of corner posts 6 are elongated structures which are angular in cross-section and which are especially slotted at the opposite ends thereof. As best seen in FIG. 12, wherein one end of the corner post 6 is shown, the special slotting includes a central slot 70 which extends a short distance longitudially of the post 6 along the junction 71 of the anglularly related surfaces 72. Cutouts 73 are made in each of the angularly related surfaces 72 to form a relatively short tab 74 in each of the surfaces 72 with those tabs 74 being laterally adjacent the central slot 70 and on opposite sides thereof. Those same cutouts 73 also provide relatively long flap members 75 in each of the angularly relates surfaces 72 with those flap members 75 located laterally adjacet their respective ones of the tabe 74 and outwardly from the central slot 70.

Assemblying of the corner post is accomplished by positioning the post 6 over the partially formed corner as shown in FIG. 12 and moving the post in the direction of the arrow 76. This movement results in the central slot 70 of the corner post 6 being positioned so as to straddle the corner junction 30 of the adjacent marginal flanges 24, and will position the relatively short tabs 74 of the corner post 6 laterally adjacent the corner junction 30 on opposite sides thereof and in juxtaposed relationship with the outwardly disposed surface of their respectively aligned ones of the marginal flanges 24. The relatively long flaps 75 of the corner post 6 are ideally positioned, as shown in FIGS. 13 through 15, so as to engage portions of the inwardly disposed surface of their respectively aligned ones of the marginal flanges 24.

With the pan interconnecting element 6 positioned as shown in FIG. 13 and described above, the next step is to collapse the partially folded corner tab 26 diagonally toward the corner junction 30 and angularly around that corner junction. As shown in FIGS. 14 and 15, collapsing of the corner tab 26 will move the inner segments 33 of the corner tab into engagement with the relatively short tabs 74 of the corner post 6 so that those tabs 74 become interlockingly interposed between the plications formed by the laterally disposed portions 32 of the collapsed corner tab 26 and their respective marginal flanges 24.

As shown best in FIGS. 15 and 16, the upwardly extending flap 40 thus positioned during collapsing of the corner tab 26 is disposed to wrap around the junction 71 of the corner post 6 and engage both of the angularly related surfaces of that post 6.

As is well known in the art, the most reliable spot welding is accomplished when only two thicknesses of metal are so welded. Thus, the most reliable way of affixing the corner post 6 of the fully collapsed corner tab is to spot weld the flap 40 to the post 6 as shown at locations 78. Also, additional spot welding is ideally accomplished by welding the marginal flanges 24 (one shown in FIG. 16) to their respective ones of the flaps 75 (one shown in FIG. 16) such as at locations 80.

Figure 17:
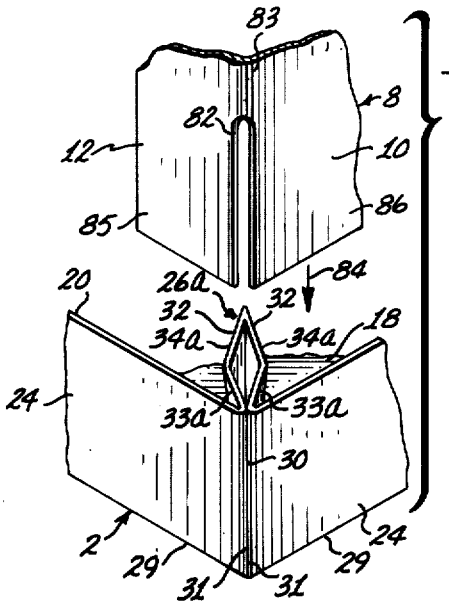
FIG. 17 is a fragmentary isometric exploded view of a pan shaped structure and a pan interconnecting structure, with the pan having the second embodiment of the corner structure of the present invention shown thereon in a partially folded position ready to receive the pan interconnecting structure.
Figure 18:
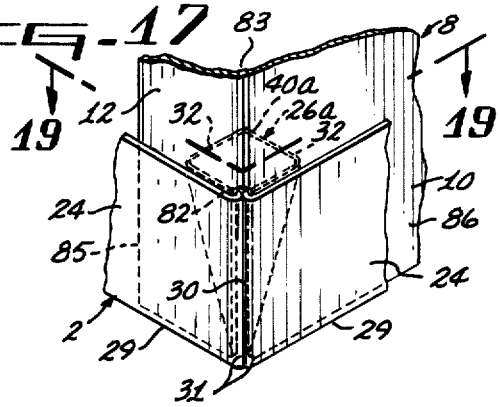
FIG. 18 is a fragmentary isometric view similar to FIG. 17 and illustrating the pan interconnecting structure assembled to the pan and the corner structure in the fully folded position.
Figure 19:
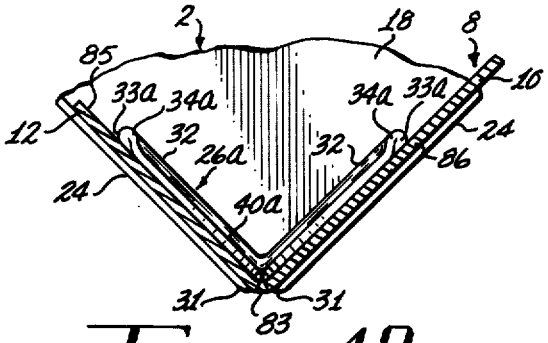
FIG. 19 is an enlarged sectional view taken on the line 19—19 of FIG. 18.

Referring now to FIGS. 17, 18, and 19 wherein a pan interconnecting structure, shown as the closing panel 8, is being installed and affixed to the second embodiment of the corner structure of the present invention.

FIG. 17 shows a fragmentary portin of the sump pan 2 as having had the marginal flanges 24 folded about the fold lines 29 to position the marginal flanges 24 normal to the planar surfaces 18. As previously described, folding of the marginal flanges 24 will move the fold lines 31 into contiguous engagement with each other at the normal corner junction 30, and will cause formation of the inwardly extending partially folded corner tab **26*a*. The formation of this second embodiment of the folded corner structure of the present invention is now ready to have the pan interconnecting element 8** assembled thereto.

As hereinbefore described, the side closing panel 8 is formed with a planar surface 10 having a pair of side flanges 12 (one shown in FIG. 17) which are normal to the planar surface 10, and the panel 8 is especially slotted at the corners thereof. As best seen in FIG. 17, wherein one corner of the panel 8 is shown, it will be seen that the special slotting in this instance is in the form of a slot 82 which extends a short distance along the junction 83 formed by the planar surface 10 and the side flange 12.

Assemblying of the panel 8 to this second embodiment of the corner structure of the present invention is accomplished by positioning the panel 8 over the partially folded corner as shown in FIG. 17 and moving the panel in the direction of arrow 84. Such a movement results in the solt 82 of the panel 8 being positioned so as to straddle the corner junction 30 of the adjacent marginal flanges 24 and will position the lower portion 85 of the side flange 12 in juxtaposed relationship with the interior of one of the marginal flanges 24 and will position the lower portion 86 of the planar surface 10 in engagement with the interior of the other marginal flange 24.

With the pan interconnecting element 8 positioned as shown in FIG. 18 and as described above, the next step is collapsing of the inwardly extending partially folded corner tab **26*a* as previously described so that the portions 85 and 86 of the panel 8 become interlockingly interposed between the plications formed by the folded laterally disposed portions 32 of the collapsed corner tab 26a and their respective marginal flanges 24**.

The flap 40a formed during collapsing of the corner tab 26a will wrap around the junction 83 of the panel 8 on the inside therof, the spot welding may be accomplished as previously described.

Figure 20:
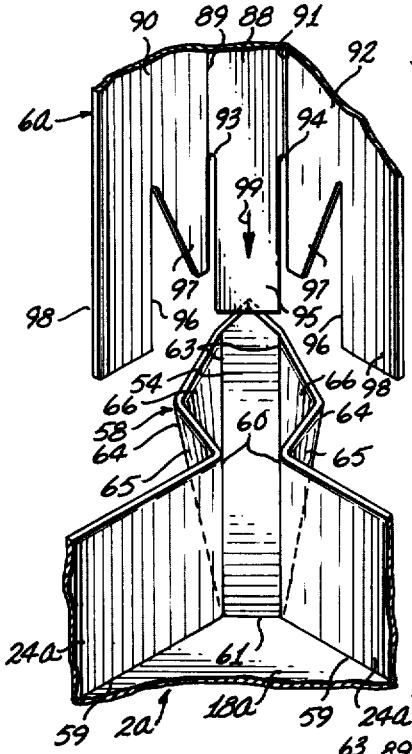
FIG. 20 is a fragmentary isometric exploded view of pan shaped structure and a pan interconnecting structure, with the pan having the third embodiment of the corner structure of the present invention shown thereon in a partially folded position ready to receive the pan interconnecting structure.
Figure 21:
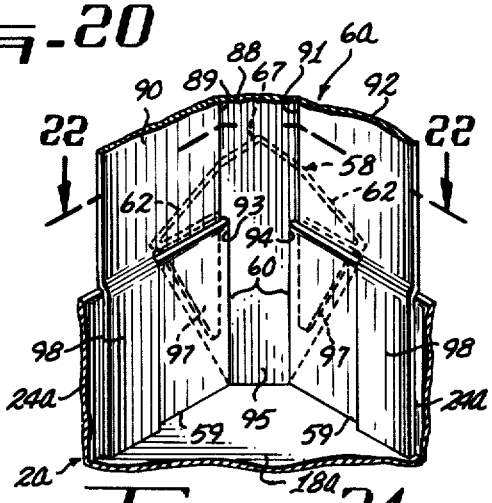
FIG. 21 is a fragmentary isometric view similar to FIG. 20 and illustrating the pan interconnecting structure assembled to the pan and having the corner structure in the fully folded position.
Figure 22:
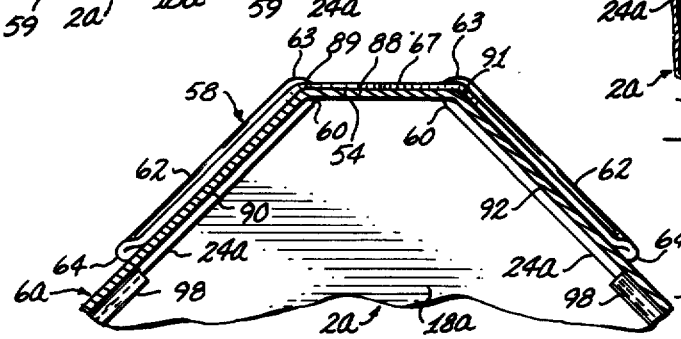
FIG. 22 is an enlarged fragmentary sectional view taken on the line 22—22 of FIG. 21.

Referring now to FIGS. 20, 21 and 22 wherein a pan interconnecting element, shown as a modified form of corner post 6a is shown as being installed and affixed to the third embodiment of the corner structure of the present invention.

FIG. 20 shows a fragmentary portion of the sump pan 2a with the marginal flanges 24a folded about the fold lines 59 so that those flanges are normal to the planar surface 18a, and the fold lines 60, which define the corner junction between the ends of the adjacent flanges 24a, are normal to the planer surface 18a and are parallel and spaced apart with respect to each other. As previously described, this action of folding the marginal flanges 24a will cause the corner tab 58 to move into the partially folded position. When formation of the sump pan 2a has reached the above described stage, assembly of the modified form of pan interconnecting element thereto is accomplished.

The pan interconnecting element 6a is similar to the previously described element 6 in that it is an elongated structure of angular cross-section and is expecially slotted at the opposite ends thereof (one shown in FIG. 20). The element 6a is modified to provide a longitudinally bevelled surface 88 forming a first junction 89 with one of the angularly related members 90 and a second junction 91 with the other angularly related member 92. The special slotting of this corner post 6a includes a first slot 93 which extends a short distance longitudinally of the post 6a along the first junction 89, and a second similar slot 94 extending along the second junction 91. The first and second slots 93 and 94, respectively, define a tail portion 95 on the end of the bevelled surface 88 between those slots. The special slotting also includes a cutout 96 formed in each of the angularly related members 90 and 92 so that a relatively short tab 97 is provided in each of the members 90 and 92 with those tabs 97 being laterally adjacent the tail portion 95 of the bevelled surface 88 on opposite sides thereof. Those same cutouts 96 also provide relatively long flap members 98 in each of the angularly related members 90 and 92 with those flaps 98 located laterally adjacent their respective ones of the tabs 97 and disposed outwardly therefrom with respct to the tail 95 of the bevelled surface 88.

Assembly of the modified corner post 6a is accomplished by positioning the post 6a over the partially folded corner as shown in FIG. 20 and moving the post 6a in the direction of the arrow 99. This movement results in the first and second slots 93 and 94 being positioned to straddle the corner junction as defined by aligned fold lines 60 between the marginal flanges 24a and the partially folded corner tab 58, and positions the tail portion 95 of the bevelled surface 88 between the fold lines 60. This same movement also positions the relatively short tabs 97 of the corner post 6a in juxtaposed relationship with the outwardly disposed surfaces of their respectively aligned ones of the marginal flanges 24a and the relatively long flaps 98 are positioned so as to engage the inwardly disposed surfaces of their respectively aligned ones of the marginal flanges 24a.

When the corner post 6a is assembled to the partially folded corner tab 58 as described above, the next step of collapsing the partially folded corner tab 58 is accomplished. This next step of collapsing the partially folded corner tab 58 which may be defined as two separate steps, is accomplished by folding thereof about the bevel fold line 61 to bring the bevelled surface 54 of the corner tab 58 normal to the planer surface 18a and into contiguous engagement with the tail 95 of the corner post 6a. The laterally disposed portions 62 of the corner tab 58 are then folded about their respective ones of the diagonal fold lines 63 to wrap the corner tab about the corner junction to bring the inner segments 65 of the laterally disposed portions 62 into contiguous engagement with the relatively short tabs 97 of the corner post 6a.

Having thus completed the above described steps of diagonally folding and wrapping, i.e., collapsing the corner tabs 58, it may now be seen that the tabs 97 have been interlockingly interposed between the plications formed by the laterally disposed portions 62 of the corner tab 58 and their respectively aligned ones of the marginal flanges 24a.

As shown best in FIG. 21, the upwardly extending flap portion 67 thus positioned during collapsing of the partially folded corner tab 58 will be in contiguous engagement with the bevelled surface 88 of the corner post 6a.

Figure 23:
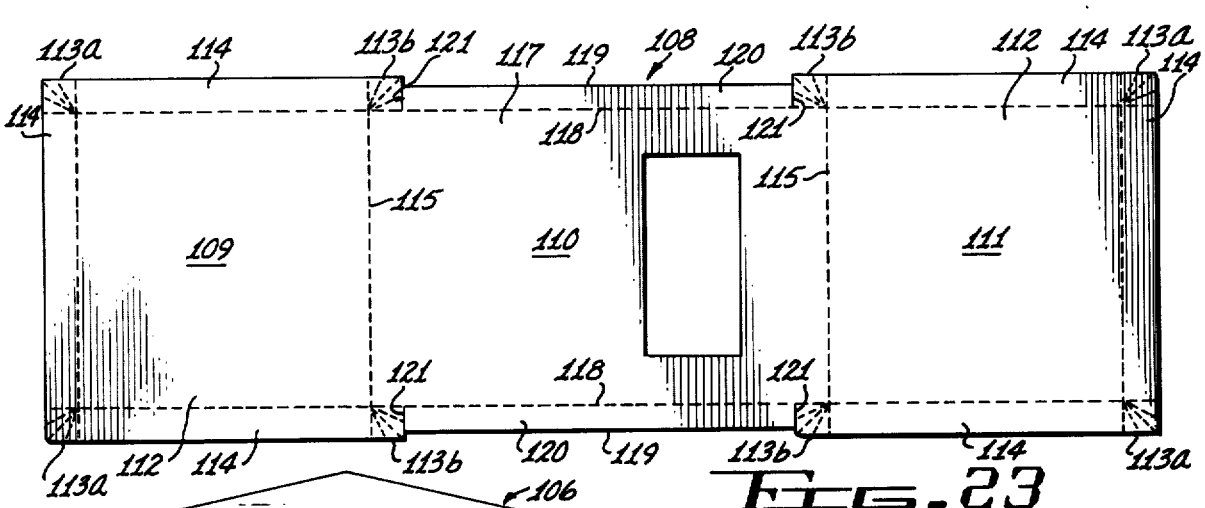
FIG. 23 is a plan view of a flat blank sheet metal illustrating, by means of broken lines, the bending and folding locations employed in forming the flat blank into an evaporative cooler housing in which the sump pan, top pan and one side closing panel are unitary.
Figure 24:
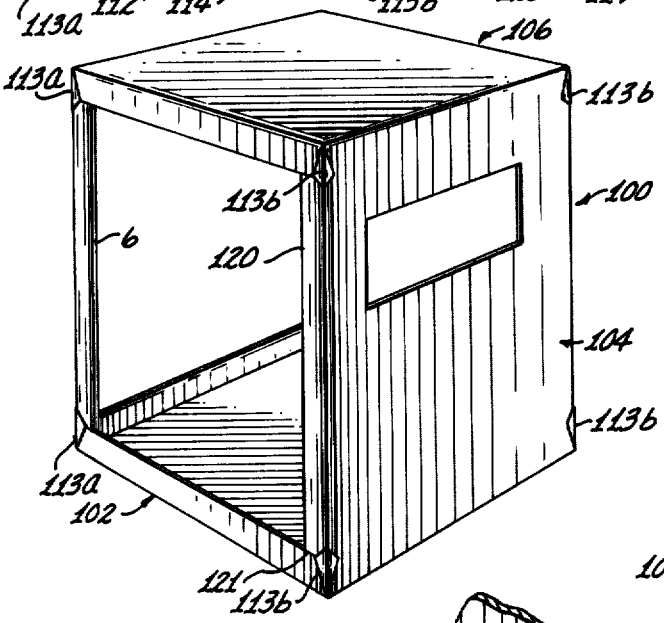
FIG. 24 is a perspective view of an evaporative cooler housing fabricated from the flat blank shown in FIG. 23.

Reference is now made to FIGS. 23 through 26 wherein the pan structure of the present invention is employed in a particular combination for fabricating a modification of the previously described evaporative cooler housing 1 (FIG. 1) with the modified version being indicated generally in FIG. 24 by the reference numberal 100. In this modified version, the sump pan 102, side closing panel 104 and the top pan 106 are integral, or unitary with each other in that they are all formed from a single flat blank 108 which is shown in FIG. 23.

The flat blank 108 is employed to fabricate a side-draft evaporative cooler housing which, as previously described, has three open sides and one closed side. The flat blank 108 comprises three main sections 109, 110, and 111 with section 109 being adapted to form the sump pan 102, section 110 being adapted to form the side closing panel 104, and section 111 being adapted to form the top pan 106, all as will hereinafter be described.

Sections 109 and 111 of the flat blank 108, which are employed in fabrication of the sump pan and the top pan 102 and 106, respectively, are each similar to the previously described flat blank 16 in that sections 109 and 111 each have a planar surface 112, unitary corner tabs 113, with the difference being that sections 109 and 111 have three marginal flanges 114, a pair of which are opposed with the third extending between the opposed pair, instead of the four described with reference to the flat blank 16. The fourth side of each of the planar surfaces 112 of sections 109 and 111 are defined by broken lines 115 which are seen to be common with section 110 and define the opposite ends thereof.

Formation of the sections 109 and 111 into the sump pan 102 and top pan 106 respectively, is accomplished in a manner similar to the previously described formation of the flat blank 16 into the sump pan 2. When the marginal flanges 114 are folded so as to be normal with respect to their respective planar surfaces 112, the flat blank 108 is also folded along the broken lines 115 so as to position section 110 normal to the planar surfaces 112 of both of the sections 109 and 111.

Such folding of the flat blank 108 will cause the open side corner tabs 113*a* and the closed side corner tabs 113*b* to be moved, as previously described, into the partially folded position due to these tabs being unitary with the marginal flanges 114 and the side closing panel 104, respectively.

Also, this same folding of the flat blank 108 will cause the top pan 106 to assume an inverted position, i.e., opens downwardly, and the top pan will be disposed directly over the sump pan 102. Thus, the sump and top pans 102 and 104, respectively, are in vertical alignment with respect to each other and are a unitary structure by virtue of the side closing panel 104 which is integral with both of the pans and extends between an aligned pair of the side edges thereof. The opposite, or free edges of the top and sump pans ae supportingly interconnected by a pair of corner posts 6 (one shown in FIG. 24) which are positioned between aligned pairs of the open side corner tabs 113*a* and are interlockingly connected thereto in the manner previously described.

Section 110 of the flat blank 108, which is employed to form the side closing panel 104, comprises a planar surface 117 which is outlined by broken lines 115 and broken lines 118. The broken lines 118 which define opposite side edges of the planar surface 117 are parallel to and spaced inwardly from opposite side edges 119 of section 110 to provide a pair of opposed side flange portions 120. The opposite ends 121 of each of the side flange portions 120 are free in that slits or other suitable breaks in the flat blank 108 are made at those locations. Thus, the opposite free ends 121 of each of the side flange portions 120 are separated from their adjacent ones of the closed side corner tabs 113*b* to allow those tabs and flanges to be folded independently of each other.

The side flange portions 120 are folded along their respective broken lines 118 so as to position those side flanges 120 normal to the planar surface 117. This same folding of the side flanges 120 will bring the opposite free ends 121 of those flange 120 into aligned engagement with the free edges 123 of the adjacent marginal flanges 114 of the sump and top pans 102 and 106. This relationship is best seen in FIG. 25.

Figure 25:
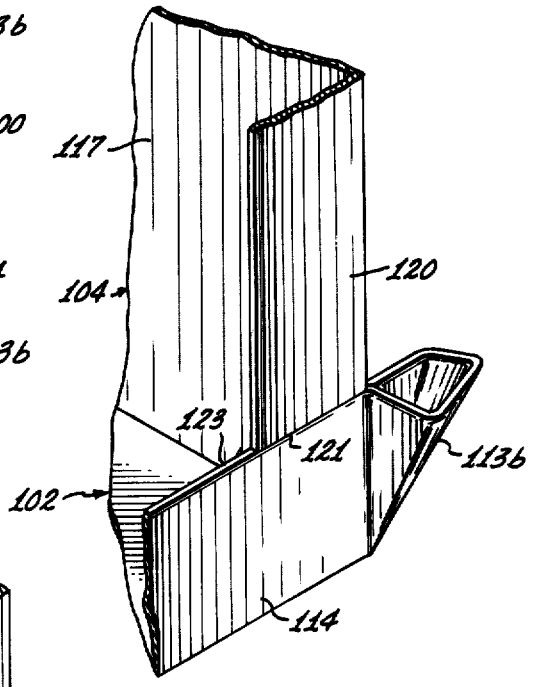
FIG. 25 is an enlarged fragmentary isometric view showing a partially formed corner of the evaporative cooler housing shown in FIG. 24.
Figure 26:
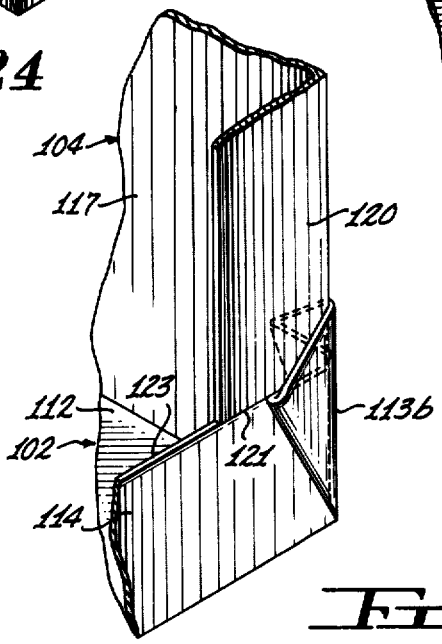
FIG. 26 is a view similar to FIG. 25 and showing the finished corner of the evaporative cooler housing shown in FIG. 24.

When the flat blank 108 is folded as described above and the corner posts 6 are in position, completion of the evaporative cooler housing 100 is accomplished by diagonally and angularly collapsing the partially folded corner tabs 113, as previously described, from the position shown in FIG. 25 to the position shown in FIG. 26.

It should now be apparent that the hereinbefore described techniques of fabricating the evaporative cooler housings 1 and 100 could be combined. For example, the side closing panel 104 may be formed unitary with the sump pan 102 only, and in such an instance, the top pan 106 would be attached to the side closing panel 104 and corner posts 6 in accordance with the previously described techniques.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A pan shaped sturcture having at least one structural member attached thereto comprising:

a. a planar surface the periphery of which is defined by a plurality of angularly related edges;

b. a marginal flange at each edge of said planar surface, said marginal flanges normal to said planar surface and unitary therewith, said marginal flanges disposed to form an angular corner junction between each of said marginal flanges;

c. a plurality of corner tab means unitary with said planar surface and said marginal flanges with a different one of said corner tab means located at each of the angular corner junctions, each of said corner tab means folded diagonally toward its respective one of the corner junctions and angularly toward the ones of said marginal flanges which form that corner junction; and d. at least one structural member normal to said planar surface, said structural member having a portion thereof interlockingly interposed between at least one of said corner tab means and the ones of said marginal flanges which form that corner junction, said structural member comprising, an elongated corner post having a pair of angularly related surfaces with that angular relationship being substantially equal to the angular relationship of said angular corner junctions, said elongated corner post having a slot formed in one end thereof which extends longitudinally along the junction between the pair of angularly related surfaces, and said elongated corner post having a cutout formed in the end of each of the pair of angularly related surfaces, each of the cutouts forming a relatively short tab in its respective one of the pair of angularly related surfaces with those tabs being laterally adjacent the slot of said corner post and on opposite sides thereof, the cutouts also forming a flap member in their respective ones of the pair of angularly related surfaces with those flap members being located laterally adjacent their respective ones of the tabs and spaced outwardly from the slot of said corner post.

2. A pan shaped structure as claimed in claim 1 wherein each of said plurality of corner tab means comprises:

a. a pair of substantially equal folded portions each disposed on an opposite side of its respective one of said corner junctions, said folded portions angularly disposed with respect to each other and adjacent different ones of said marginal flanges which form its respective one of said corner junctions; and b. a flap portion extending beyond its respective one of said corner junctions and the ones of said marginal flanges which form that corner junction.

3. A pan shaped structure as claimed in claim 1 wherein each of said plurality of corner tab means comprises:

a. a pair of substantially equal folded portions each disposed on opposite lateral sides of its respective one of said corner junctions, said folded portions angularly disposed with respect to each other and each adjacent the outwardly facing surface of a different one of said marginal flanges which form its respective one of said corner junctions; and b. a flap portion folded extending beyond its respective one of said corner junctions and the ones of said marginal flanges which form that corner junction.

4. A pan shaped structure as claimed in claim 1 wherein each of said plurality of corner tab means comprises:

a. a pair of substantially equal folded portions each disposed on opposite lateral sides of its respective one of said corner junctions, said folded portions angularly disposed with respect to each other and each in contiguous engagement with the inwardly facing surface of a different one of said marginal flanges which form its respective one of said corner junctions; and b. a flap portion folded outwardly over and around its respective one of said corner junctions and the ones of said marginal flanges which form that corner junction.

5. A pan shaped sturcture as claimed in claim 1 wherein each of said corner junctions if formed by the adjacent ends of an adjacent pair of said marginal flanges with those adjacent ends being in contiguous abutting relationship with respect to each other and normal to said planar surface.

6. A pan shaped structure as claimed in claim 1 wherein at least one of said marginal flanges extends from said planar surface further than the remaining ones of said marginal flanges.

7. A pan shaped structure having at least one structural member attached thereto comprising:

a. a planar surface the periphery of which is defined by a plurality of angularly related edges;

b. a marginal flange at each edge of said planar surface, said marginal flanges normal to said planar surface and unitary therwith, said marginal flanges disposed to form an angular corner junction between each of said marginal flanges;

c. a plurality of corner tab means unitary with said planar surface and said marginal flanges with a different one of said corner tab means located at each of the angular corner junctions, each of said corner tab means folded diagonally toward its respective one of the corner junctions and angularly toward the ones of said marginal flanges which form that corner junction; and d. At least one structural member normal to said planar surface, said structural member having a portion thereof interlockingly interposed between at least one of said corner tab means and the ones of said marginal flanges which form that corner junction, said structural member comprising, an elongated corner post having a pair of longitudinally extending angularly related surfaces and a longitudinally extending bevelled surface between the pair of angularly related surfaces, said elongated corner post having a pair of spaced apart parallel slots formed in one end thereof, each of the slots extending longitudinally along a different one of the junctions of the pair of angularly related surfaces with the bevel surface, and said elongated corner post having a cutout formed in the end of each of the pair of angularly related surfaces, each of the cutouts forming a relatively short tab in its respective one of the pair of angularly related surfaces with those tabs being laterally adjacent the bevel surface of said corner post and on opposite sides thereof, the cutouts also forming a flap member in their respective ones of the pair of angularly related surfaces with those flap members being laterally adjacent their respective ones of the tabs and spaced outwardly from the bevelled surface of said corner post.

8. A pan shaped structure as claimed in claim 7 wherein each of said plurality of corner tab means comprises:

a. a bevel surface in engagement with its respective one of said corner junctions;

b. a pair of substantially equal folded portions each extending laterally and angularly from opposite sides of said bevel surface, each of said folded portions adjacent a different one of said marginal flanges which form its respective one of said corner junctions; and c. a flap portion extending beyond its respective one of said corner junctions and the ones of said marginal flanges which form that corner junction.

9. A pan shaped structure as claimed in claim 7 wherein each of said corner junctions is formed by adjacent ends of an adjacent pair of said marginal flanges with those adjacent ends being spaced apart and parallel with respect to each other and normal to said planar surface.

10. A pan shaped structure having at least one structural member attached thereto comprising:

a. a planar surface the periphery of which is defined by a plurality of angularly related edges;

b. a marginal flange at each edge of said planar surface, said marginal flanges normal to said planar surface and untiary therewith, said marginal flanges disposed to form an angular corner junction between each of said marginal flanges;

c. a plurality of corner tab means unitary with said planar surface and said marginal flanges with a different one of said corner tab means located at each of the angular corner junctions, each of said corner tab means folded diagonally toward its respective one of the corner junctions and angularly toward the ones of said marginal flanges which form that corner junction; and d. at least one structural member normal to said planar surface, said structural member having a portion thereof interlockingly interposed between at least one of said corner tab means and the ones of said marginal flanges which form that corner junction, said structural member comprising, a panel member having opposite side flanges which are angularly related to said panel member and unitary therewith, the angular relationship of the side flanges with respect to said panel member being substantially equal to the angular relationship of said angular corner junctions, said panel member having a pair of slots formed therein each of which extends from one end of said panel member longitudinally along a different one of the junctions between said panel member and the opposite side flanges thereof, and said panel member having a cutout on each of the opposite sides of each of the slots formed therein, each of those cutouts forming a relatively short tab laterally adjacent to its respective one of the slots and a flap member laterally adjacent its respective one of the tabs and spaced outwardly from its respective one of the slots in said panel member.

11. A pan shaped structure having at least one structural member attached thereto comprising:

a. a planar surface the periphery of which is defined by a plurality of angularly related edges;

b. a marginal flange at each edge of said planar surface, said marginal flanges normal to said planar surface and unitary therewith, said marginal flanges disposed to form an angular corner junction between each of said marginal flanges;

c. a plurality of corner tab means unitary with said planar surface and said marginal flanges with a different one of said corner tab means located at each of the angular corner junctions, each of said corner tab means folded diagonally toward its respective one of the corner junctions and angularly toward the ones of said marginal flanges which form that corner junction; and d. at least one structural member normal to said planar surface, said structural member having a portion thereof interlockingly interposed between at least one of said corner tab means and the ones of said marginal flanges which form that corner junction, said structual member comprising, a panel member having at least one side flange with a bevel surface between that side flange and said panel member, the side flange unitary with and angularly related to the bevel surface and said panel member with that angular relationship being substantially equal to the angular relationship of said angular corner junctions, said panel member having a pair of spaced apart parallel slots therein, each of said slots extending from one end of said panel member longitudinally along a different one of the junctions of the side flange with the bevel surface and said panel member with the bevel surface, and said panel member having a pair of cutouts formed therein with a first one of those curouts forming a relatively short tab and a flap member in the side flange laterally adjacent the slot between the side flange and the bevel surface and the second one of the cutouts forming a relatively short tab and a flap member in said panel member laterally adjacent the slot between said panel member and the bevel surface thereof.

12. An evaporative cooler housing comprising:

a. a sump pan having an opposed pair of upstanding marginal flanges;

b. a top pan having an opposed pair of depending marginal flanges, said top pan spaced from and in vertical alignment with said sump pan;

c. a side closing panel unitary with said sump pan and with said top pan and disposed to extend between aligned sides thereof, said side closing panel forming a corner junction with each of two aligned ends of the pair of opposed marginal flanges of said sump pan and forming a corner junction with each of two aligned ends of the pair of opposed marginal flanges of said top pan; and d. four corner tabs each associated with a different one of the corner junctions formed between said side closing panel and the opposed marginal flanges of said sump pan and said top pan, each of said corner tabs unitary with said side closing panel and the particular one of the marginal flanges which form its associated one of the corner junctions, each of said corner tabs folded diagonally into contiguous engagement with its associated one of the corner junctions and wrapped therearound.

13. An evaporative cooler housing as claimed in claim 12 and further comprising:

a. a thrid upstanding marginal flange on said sump pan opposite to the side from which said side closing panel extends, said third upstanding marginal flange extending between the opposed pair of upstanding marginal flanges to form open side corner junctions and corner tabs unitary therewith, those corner tabs being diagonally folded toward their respective ones of the open side corner junctions and wrapped therearound;

b. a third depending marginal flange on said top pan opposite to the side from which said side closing panel extends, said third depending marginal flange extending between the opposed pair of depending marginal flanges to form open side corner junctions and corner tabs unitary therewith, those corner tabs being diagonally folded toward their respective ones of the open side corner junctions and wrapped therearound; and c. a corner post interlockingly interposed on one end thereof between one of the open side corner tabs and its respective one of the open side corner junctions of said sump pan, said corner post interlockingly interposed on the other end thereof between an aligned one of the open side corner tabs and its respective one of the open side corner junctions of said top pan.

* * * * *